US009199823B2

(12) United States Patent
Penfield

(10) Patent No.: US 9,199,823 B2
(45) Date of Patent: Dec. 1, 2015

(54) STACK OF FOLDED PAPER PRODUCTS

(71) Applicant: Georgia-Pacific Consumer Products LP, Atlanta, GA (US)

(72) Inventor: Robert Michael Penfield, Marietta, GA (US)

(73) Assignee: GEORGIA-PACIFIC CONSUMER PRODUCTS LP, Atlanta, GA (US)

( * ) Notice: Subject to any disclaimer, the term of this patent is extended or adjusted under 35 U.S.C. 154(b) by 177 days.

(21) Appl. No.: 13/970,009

(22) Filed: Aug. 19, 2013

(65) Prior Publication Data

US 2015/0050452 A1 Feb. 19, 2015

(51) Int. Cl.
*A47K 10/16* (2006.01)
*B65H 45/24* (2006.01)

(52) U.S. Cl.
CPC ..... *B65H 45/24* (2013.01)

(58) Field of Classification Search
CPC ..... Y10T 428/2464; A47K 10/16; B65H 2701/1924; B65H 2701/1123; B65H 2301/2411; B65H 2301/42112; B65H 2301/42114
USPC ..... 428/121, 124, 126, 130
See application file for complete search history.

(56) References Cited

U.S. PATENT DOCUMENTS

| | | | | |
|---|---|---|---|---|
| 4,679,703 | A | 7/1987 | De Luca | |
| 6,585,129 | B2 | 7/2003 | Moody et al. | |
| 6,602,575 | B2 * | 8/2003 | Lefevre Du Grosriez et al. | 428/124 |
| 6,622,888 | B2 | 9/2003 | Boone et al. | |
| 6,874,653 | B2 | 4/2005 | Boone et al. | |
| 6,892,898 | B1 | 5/2005 | Boone et al. | |
| 7,341,166 | B2 | 3/2008 | Reinsel et al. | |
| 7,546,934 | B2 | 6/2009 | Reinsel et al. | |
| 7,568,593 | B2 | 8/2009 | Cittadino et al. | |
| 7,611,765 | B2 | 11/2009 | Hochtritt et al. | |
| 7,938,294 | B2 | 5/2011 | Cittadino et al. | |
| 7,939,159 | B2 | 5/2011 | Hochtritt et al. | |
| 8,273,443 | B2 | 9/2012 | Hochtritt et al. | |
| 8,609,223 | B2 * | 12/2013 | Carlson | 428/126 |
| 2012/0196082 | A1 | 8/2012 | Hochtritt et al. | |

* cited by examiner

*Primary Examiner* — Alexander Thomas
(74) *Attorney, Agent, or Firm* — William W. Letson

(57) ABSTRACT

A stack of folded paper products. The stack can include first and second paper products, each having first and second centerlines and first and second fold lines. The first fold line can be substantially parallel to, and offset from, the first centerline. The second centerline can be substantially perpendicular to the first centerline. The second fold line can be substantially parallel to the second centerline. The first and second paper products can each be folded about the first fold line prior to being folded about the second fold line, thereby forming first and second larger panels and first and second smaller panels. At least one of the panels of the second paper product can be at least partially disposed between at least two of the panels of the first paper product.

21 Claims, 11 Drawing Sheets

STACK OF FOLDED PAPER PRODUCTS

BACKGROUND

1. Field

Embodiments described herein generally relate to folded paper products. More particularly, such embodiments relate to folded paper napkins that are arranged to form a stack.

2. Description of the Related Art

Paper products, such as napkins, are folded and then placed one on top of another to form a stack. Each fold is generally about a centerline of the napkin such that the surface area of the napkin is reduced by a factor of two. For example, a napkin can be folded a first time to form two evenly sized panels. The napkin can then be folded a second time to form four evenly sized panels. The napkins can be placed one on top of another and inserted into a dispenser.

Withdrawing a single napkin from a dispenser can inadvertently lead to two or more napkins being inadvertently withdrawn. To overcome this, a panel from each napkin can be inserted between at least two panels of the adjacent napkin prior to loading the napkins into the dispenser. This is referred to as "interfolding." If a user desires to load additional napkins into the dispenser before the dispenser is empty, however, one of the new napkins must be interfolded with one of the napkins already disposed within the dispenser. This can be difficult and time consuming. There is a need, therefore, for an improved method for folding paper products and stacking same.

SUMMARY

Stacks of folded paper products and methods for making same are provided. The stack of folded paper products can include first and second paper products, each having first and second centerlines and first and second fold lines. The first fold line can be substantially parallel to, and offset from, the first centerline. The second centerline can be substantially perpendicular to the first centerline. The second fold line can be substantially parallel to the second centerline. The first and second paper products can each be folded about the first fold line prior to being folded about the second fold line, thereby forming first and second larger panels and first and second smaller panels. At least one of the panels of the second paper product can be at least partially disposed between at least two of the panels of the first paper product.

The method for forming a stack of folded paper products can include folding a first paper product about a first fold line that is substantially parallel to, and offset from, a first centerline extending therethrough. The first paper product can then be folded about a second fold line that is substantially perpendicular to the first fold line after the first paper product is folded about the first fold line, thereby forming first and second larger panels and first and second smaller panels. A second paper product can be folded about a first fold line that is substantially parallel to, and offset from, a first centerline extending therethrough. The second paper product can then be folded about a second fold line that is substantially perpendicular to the first fold line after the second paper product is folded about the first fold line, thereby forming first and second larger panels and first and second smaller panels. At least one of the panels of the second paper product can be inserted at least partially between at least two of the panels of the first paper product.

A stack of folded paper napkins is also disclosed. The stack can include first and second paper napkins, each having first and second centerlines and first and second fold lines. The first fold line can be substantially parallel to, and offset from, the first centerline. The second centerline can be substantially perpendicular to the first centerline. The second fold line can be substantially parallel to, and substantially aligned with, the second centerline. The first and second paper napkins can each be folded about the first fold line prior to being folded about the second fold line, thereby forming first and second larger panels that are each at least partially disposed between first and second smaller panels. The first and second larger panels of the first and second paper napkins can each include an offset section that extends a distance beyond the first and second smaller panels. At least one of the panels of the second paper napkin can be at least partially disposed between at least two of the panels of the first paper napkin.

DETAILED DESCRIPTION

Figure 1:
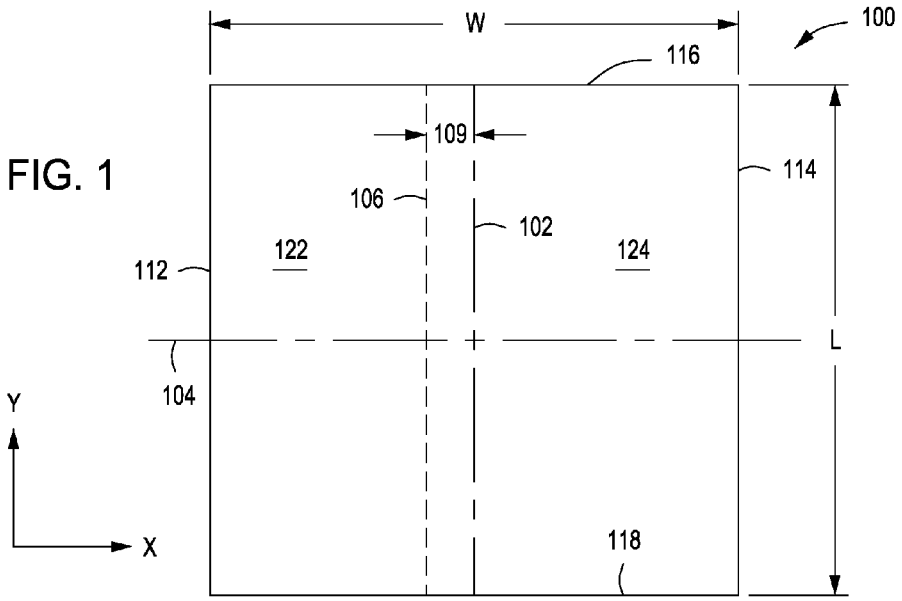
FIG. 1 shows a top view of an illustrative paper product prior to folding, according to one or more embodiments described.

FIG. 1 shows a top view of an illustrative paper product 100 prior to folding, according to one or more embodiments. As shown, the paper product 100 can have a length L, a width W, and a thickness T. The paper product 100 can be any one or more napkins, tissues, paper towels, or other consumable paper products, and any one or more combinations thereof. The paper product 100 can have any suitable shape or size and if more than one type, each paper product 100 can vary in shape or size or both shape and size. Illustrative shapes can include squares, rectangles, polygons, ovals, elliptical, and circles, to name a few. For simplicity and ease of illustration, however, the paper product 100 will be further described with reference to a rectangular shape having a length (L) that is greater than a width (W).

The paper product 100 can also have at least two centerlines that are substantially perpendicular to one another. As shown in FIG. 1, the paper product 100 can have two centerlines (first and second centerlines 102, 104). The first centerline 102 can be equidistant or substantially equidistant between first and second opposing sides 112, 114 of the paper product 100. The second centerline 104 can be equidistant or substantially equidistant between third and fourth opposing sides 116, 118 of the paper product 100.

The paper product 100 can have a first fold line 106 about which the paper product 100 can be folded to form two portions, sections, or panels 122, 124. The first fold line 106 can be substantially parallel to the first centerline 102. The first fold line 106 can be on the first centerline 102 or can be spaced apart (i.e., offset) from the first centerline 102 by a distance 109. The distance 109 can be about 0.05 in (1.27 mm), about 0.10 in (2.54 mm), about 0.20 in (5.08 mm), about 0.30 in (7.62 mm), about 0.40 in (10.2 mm), or about 0.50 in (12.7 mm) to about 0.60 in (15.2 mm), about 0.80 in (20.3 mm), about 1.0 in (25.4 mm), about 1.5 in (38.1 mm), about 2.0 in (50.8 mm), about 3.0 in (76.2 mm), or more. For example, the distance 109 can be about 0.10 (2.54 mm) in to about 3.0 in (76.2 mm), about 0.2 in (5.08 mm) to about 2.0 in (50.8 mm), or about 0.3 in (7.62 mm) to about 1.0 in 25.4 mm).

The length L of the paper product 100 can be about 2 in (5.08 cm), about 4 in (10.2 cm), about 6 in (15.2 cm), about 8 in (20.3 cm), or about 10 in (25.4 cm) to about 15 in (38.1 cm), about 20 in (50.8 cm), about 25 in (63.5 cm), about 30 in (76.2 cm), about 35 in (88.9 cm), or more. For example, the length L can be from about 2 in (5.08 cm) to about 30 in (76.2 cm), about 4 in (10.2 cm) to about 20 in (50.8 cm), or about 6 in (15.2 cm) to about 15 in (38.1 cm).

The width W of the paper product 100 can be about 2 in (5.08 cm), about 4 in (10.2 cm), about 6 in (15.2 cm), about 8 in (20.3 cm), or about 10 in (25.4 cm) to about 15 in (38.1 cm), about 20 in (50.8 cm), about 25 in (63.5 cm), about 30 in (76.2 cm), about 35 in (88.9 cm), or more. For example, the width W can be from about 2 in (5.08 cm) to about 30 in (76.2 cm), about 4 in (10.2 cm) to about 20 in (50.8 cm), or about 6 in (15.2 cm) to about 15 in (38.1 cm).

A ratio of the distance 109 to the width W can be about 1:60, about 1:50, about 1:40, about 1:30, about 1:20, or about 1:15 to about 1:10, about 1:8, about 1:6, about 1:4, or about 1:2. For example, the ratio can be about 1:4 to about 1:8; about 1:4 to about 1:12; about 1:6 to about 1:10; about 1:6 to about 1:14; about 1:8 to about 1:12; about 1:8 to about 1:16; about 1:10 to about 1:15; about 1:10 to about 1:20; about 1:15 to about 1:20; about 1:15 to about 1:25; about 1:20 to about 1:25; about 1:20 to about 1:30; about 1:to about 1:40; about 1:40 to about 1:50; or about 1:50 to about 1:60.

Figure 2:
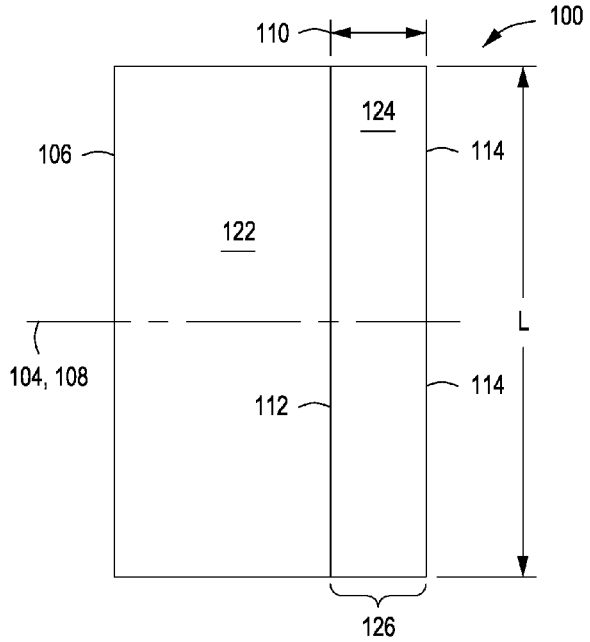
FIG. 2 shows a top view of the paper product shown in FIG. 1 after the paper product has been folded about a first fold line, thereby forming two panels, according to one or more embodiments described.
Figure 3:
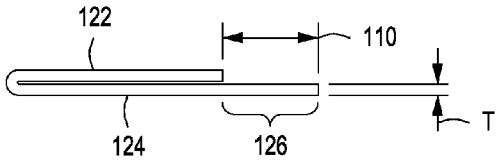
FIG. 3 shows an end view of the paper product shown in FIG. 2, according to one or more embodiments described.

FIG. 2 shows a top view of the paper product 100 after being folded about the first fold line 106, according to one or more embodiments. The first panel 122 can be on top of the second panel 124, or the first panel 122 can be beneath the second panel 124. As depicted, the first and second panels 122, 124 rest one on top of the other. The first and second sides 112, 114 of the paper product 100 can be offset from one another by a distance 110 ("offset distance"). The offset distance 110 will be twice as much as the distance 109. As such, one panel, (e.g., the first panel 122) has a smaller surface area than the other panel (e.g., the second panel 124). As a result, the second panel 124 has an offset section 126 that does not overlap with the first panel 122, as depicted in FIG. 3.

The offset distance 110 can be about 0.10 in (2.54 mm), about 0.20 in (5.08 mm), about 0.30 in (7.62 mm), about 0.40 in (10.2 mm) or about 0.50 in (12.7 mm) to about 0.75 in (19 mm), about 1.0 in (25.4 mm), about 1.5 in (38.1 mm), about 2.0 in (50.8 mm), about 3.0 in (76.2 mm), about 4.0 in (102 mm), about 5.0 in (127 mm), or more. For example, the offset distance 110 can be from about 0.10 in (2.54 mm) to about 2.0 in (50.8 mm), from about 0.20 in (5.08 mm) to about 1.0 in (25.4 mm), or from about 0.30 in (7.62 mm) to about 0.75 in (19 mm).

A ratio of the offset distance 110 to the width W (or length L) can be about 1:40, about 1:35, about 1:30, about 1:25, about 1:20, about 1:15, about 1:10, or about 1:7.5 to about 1:5, about 1:4, about 1:3, or about 1:2. For example, the ratio can be about 1:2 to about 1:40; about 1:2 to about 1:4; about 1:2 to about 1:6; about 1:3 to about 1:5; about 1:3 to about 1:7; about 1:4 to about 1:6; about 1:4 to about 1:8; about 1:5 to about 1:7.5; about 1:5 to about 1:10; about 1:7.5 to about 1:10; about 1:7.5 to about 1:12.5; about 1:10 to about 1:12.5; about 1:10 to about 1:15; about 1:15 to about 1:20; about 1:15 to about 1:25; about 1:20 to about 1:30, about 1:25 to about 1:35, or about 1:30 to about 1:40.

Figure 4:
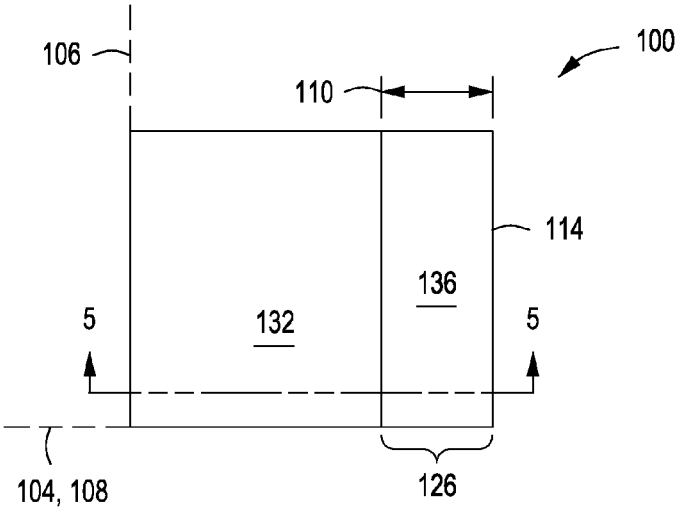
FIG. 4 shows a top view of the paper product shown in FIG. 2 after the paper product has been folded about a second fold line, thereby forming four panels, according to one or more embodiments described.

The paper product 100 can have a second fold line 108 about which the paper product 100 can be folded to split, separate, or otherwise divide each of the two panels 122, 124 into two other panels, thereby forming four panels 132, 134, 136, 138, as shown in FIG. 4. The second fold line 108 can be substantially parallel to the second centerline 104.

As shown, the second fold line 108 can be aligned or coaxial with the second centerline 104 and perpendicular to the first fold line 106. Although not shown, the second fold line 108 could also be spaced apart or offset from the second centerline 104. Such offset could be about 0.05 in (1.27 mm), about 0.10 in (2.54 mm), about 0.20 in (5.08 mm), about 0.30 in (7.62 mm), about 0.40 in (10.2 mm), or about 0.50 in (12.7 mm) to about 0.60 in (15.2 mm), about 0.80 in (20.3 mm), about 1.0 in (25.4 mm), about 1.5 in (38.1 mm), about 2.0 in (50.8 mm), about 3.0 in (76.2 mm), or more, depending on the design of the dispenser into which the paper product 100 can be loaded.

FIG. 3 shows an end view of the paper product 100 after being folded about the first fold line 106, according to one or more embodiments. The thickness T of the paper product 100 can be about 0.0005 in (0.013 mm), about 0.0010 in (0.025 mm), about 0.0025 in (0.064 mm), about 0.0050 in (0.13 mm), about 0.0075 in (0.19 mm), or about 0.010 in (0.25 mm) to about 0.025 in (0.64 mm), about 0.050 in (1.27 mm), about 0.075 in (1.90 mm), about 0.10 in (2.54 mm), or more. For example, the thickness T can be from about 0.0005 in (0.013 mm) to about 0.10 in (2.54 mm), from about 0.0025 in (0.064 mm) to about 0.050 in (1.27 mm), or from about 0.0050 in (0.13 mm) to about 0.025 in (0.64 mm).

FIG. 4 shows a top view of the paper product 100 after being folded about the second fold line 108, according to one or more embodiments. After the paper product 100 is folded about the first fold line 106, the paper product 100 can then be folded about the second fold line 108 to form four stacked panels.

Figure 5:
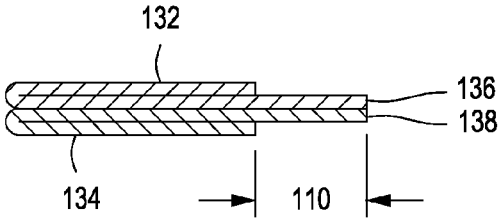
FIG. 5 shows a cross-sectional view of the paper product shown in FIG. 4 taken along the line 5-5, according to one or more embodiments described.
Figure 6:
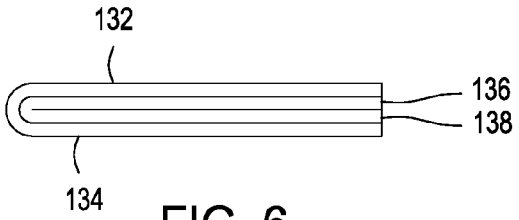
FIG. 6 shows an end view of the paper product that is perpendicular to the view shown in FIG. 5, according to one or more embodiments described.

FIG. 5 shows a cross-sectional view of the paper product 100 taken along the line 5-5 in FIG. 4, and FIG. 6 shows an end view of the paper product 100 that is perpendicular to the view shown in FIG. 5, according to one or more embodiments. Folding the paper product 100 about the second fold line 108 forms two smaller panels 132, 134 and two larger panels 136, 138. Once folded about the second fold line 108, the two larger panels 136, 138 will be positioned at least partially between the two smaller panels 132, 134. After the second fold about the second fold line 108, the order of the panels 132, 134, 136, 138 from top to bottom will be: the first smaller panel 132, the first larger panel 136, the second larger panel 138, and the second smaller panel 134.

Two or more folded paper products 100 can be inserted into one another or otherwise assembled together to form a stack. At least one paper product 100 can be flipped about its horizontal (x-axis) or vertical axis (y-axis) and/or rotated about its horizontal axis prior to assembly. For instance, the folded paper product 100 of FIG. 6 can be flipped about its x-axis and/or its y-axis so that the panel 132 is oriented on the bottom. The paper product 100 can also be rotated, about its horizontal axis, 90°, 180°, or 270°, or any other angle therebetween. The rotation can occur before or after flipping. Similarly, the paper product 100 can be flipped before or after being rotated. The flipping and/or rotation moves the orientation of the fold lines 106, 108, which rearranges the panels 132, 134, 136, 138 to provide varying stacked arrangements. Some examples of differing stacked arrangements are depicted in FIGS. 7-18 and described in more detail below, although other and equally effective arrangements can be used.

Figure 7:
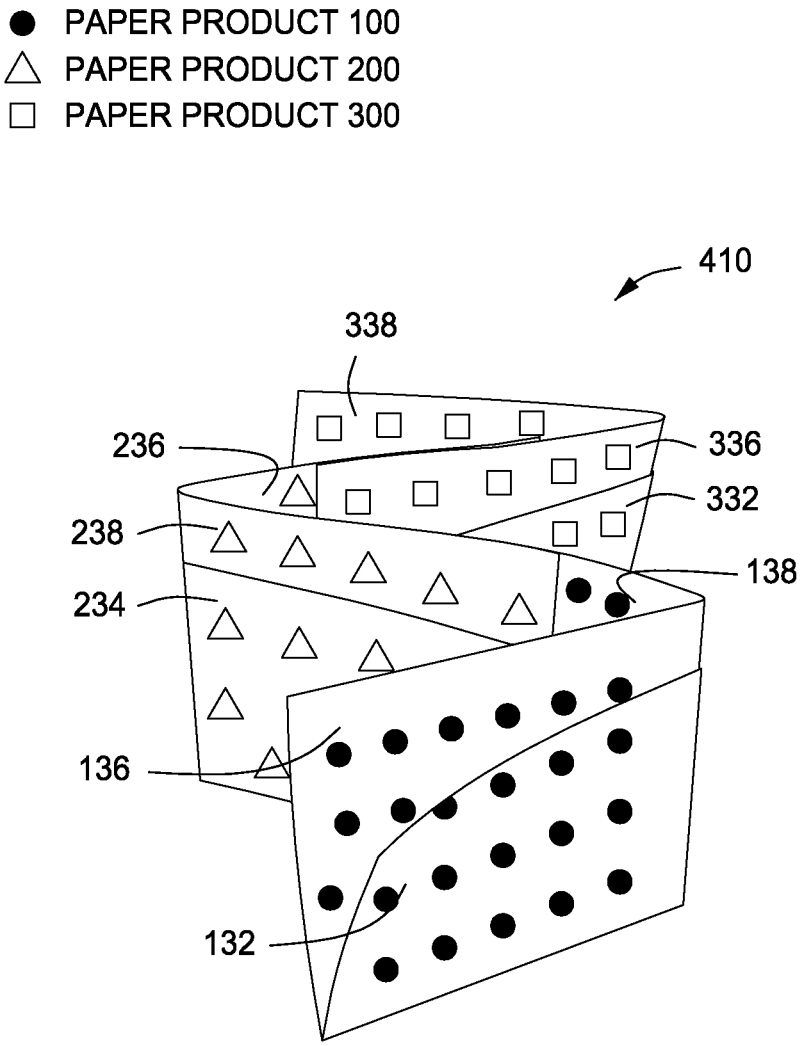
FIG. 7 shows a perspective view of a stack of a plurality of illustrative paper products after being assembled to form a first stack, according to one or more embodiments described.

FIG. 7, for example, shows a perspective view of three paper products being assembled to form a first illustrative stack 410, according to one or more embodiments. To form the first stack 410, any portion of the panels 232, 234, 236, 238 of the second paper product 200 can be inserted at least partially between any two of the panels 132, 134, 136, 138 of the first paper product 100. Likewise, any portion of the panels 332, 334, 336, 338 of the third paper product 300 can be inserted at least partially between any two of the panels 232, 234, 236, 238 of the second paper product 200, and so on. The offset sections 126 (see FIG. 4) of the paper products 100, 200, 300 can be aligned.

In another embodiment, at least one of the panels 232, 234, 236, 238 of the second paper product 200 can be positioned between any two of the panels 132, 134, 136, 138 of the first paper product 100 during the folding process, as opposed to after the paper products 100, 200 have been folded. Although three paper products 100, 200, 300 are shown in the first stack 410, it may be appreciated that any number of paper products can be used. For example, the number can be from about 2, about 5, about 10, about 20, or about 50 to about 100, about 250, about 500, about 1000, about 5000, or more.

Figure 8:
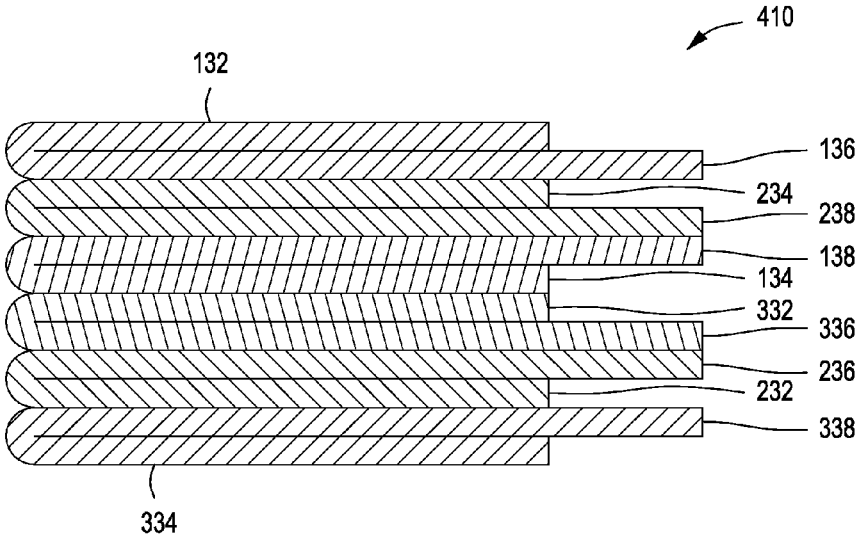
FIG. 8 shows a cross-sectional view of the stack shown in FIG. 7, according to one or more embodiments described.
Figure 9:
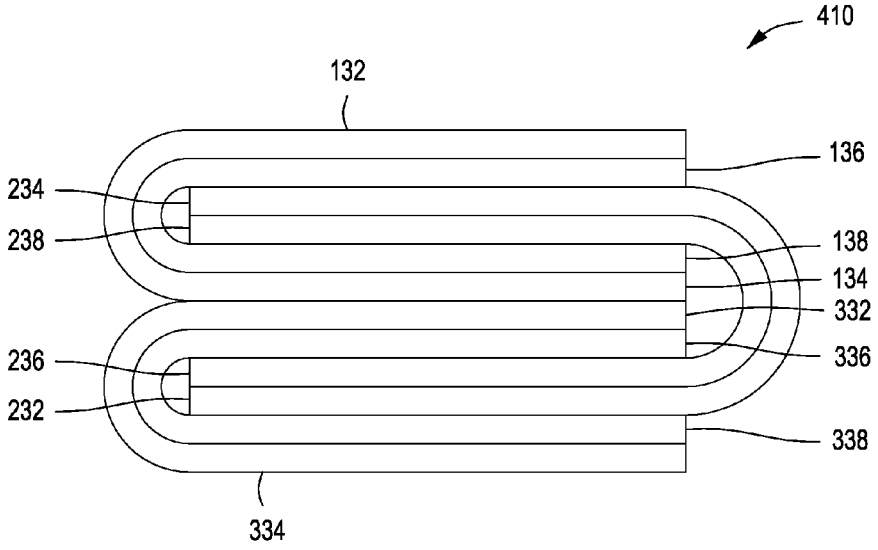
FIG. 9 shows an end view of the stack that is perpendicular to the view shown in FIG. 8, according to one or more embodiments described.

FIG. 8 shows a cross-sectional view of the first stack 410, and FIG. 9 shows an end view of the first stack 410 that is perpendicular to the view shown in FIG. 8, according to one or more embodiments described. The first stack 410 can be assembled as follows: (1) the first smaller panel 132 of the first paper product 100, (2) the first larger panel 136 of the first paper product 100, (3) the second smaller panel 234 of the second paper product 200, (4) the second larger panel 238 of the second paper product 200, (5) the second larger panel 138 of the first paper product 100, (6) the second smaller panel 134 of the first paper product 100, (7) the first smaller panel 332 of the third paper product 300, (8) the first larger panel 336 of the third paper product 300, (9) the first larger panel 236 of the second paper product 200, (10), the first smaller panel 232 of the second paper product 200, (11) the second larger panel 338 of the third paper product 300, and (12) the second smaller panel 334 of the third paper product 300.

Figure 10:
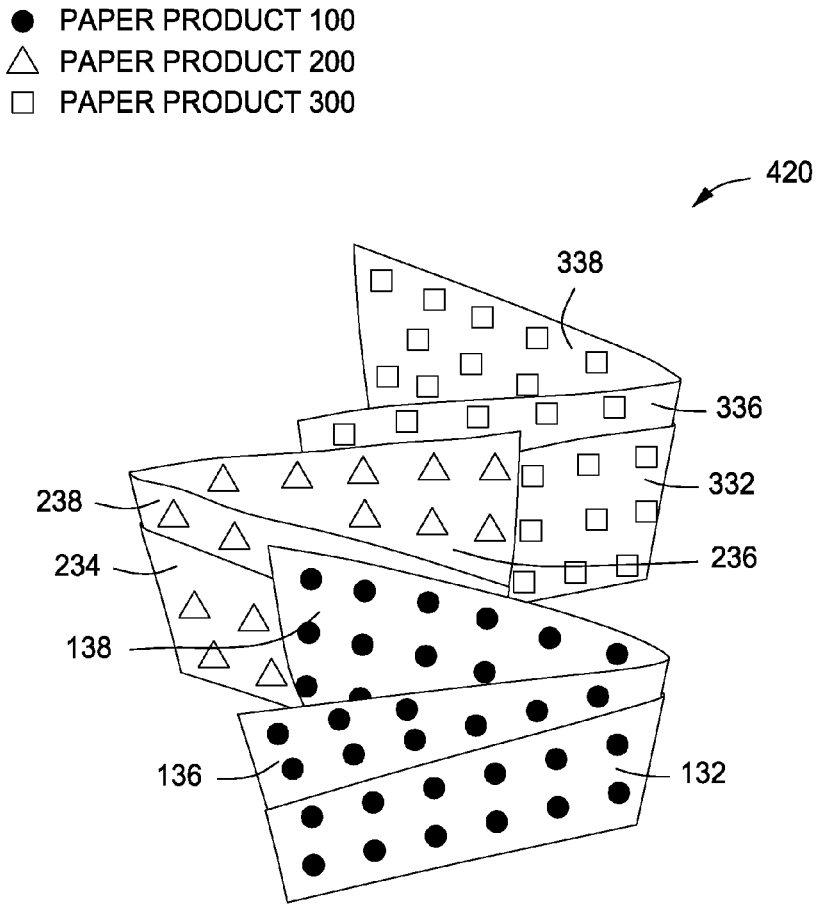
FIG. 10 shows a perspective view of another stack of a plurality of illustrative paper products after being assembled to form a second stack, according to one or more embodiments described.

FIG. 10 shows a perspective view of the paper products 100, 200, 300 after being assembled to form a second illustrative stack 420, according to one or more embodiments. Similar to the first stack 410, the offset sections 126 (see FIG. 4) of the paper products 100, 200, 300 can be aligned in the second stack 420. To form the second stack 420, any portion of the panels 232, 234, 236, 238 of the second paper product 200 can be inserted at least partially between any two of the panels 132, 134, 136, 138 of the first paper product 100. Likewise, any portion of the panels 332, 334, 336, 338 of the third paper product 300 can be inserted at least partially between any two of the panels 232, 234, 236, 238 of the second paper product 200, and so on.

Figure 11:
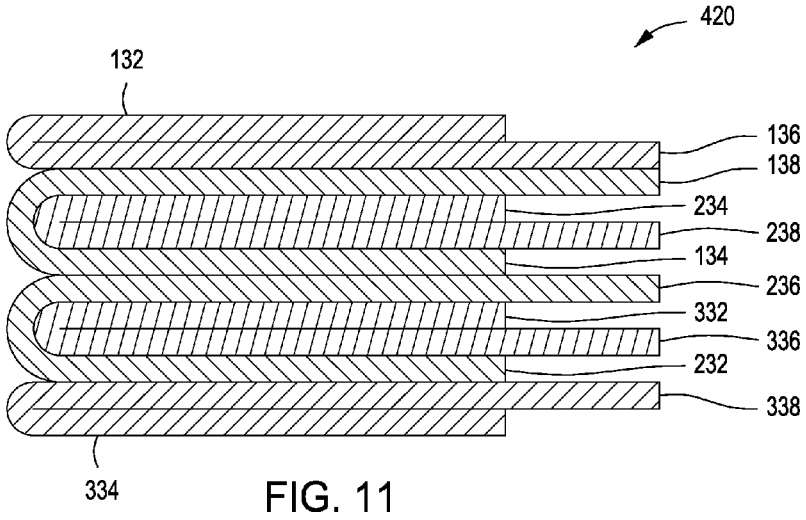
FIG. 11 shows a cross-sectional view of the stack shown in FIG. 10, according to one or more embodiments described.
Figure 12:
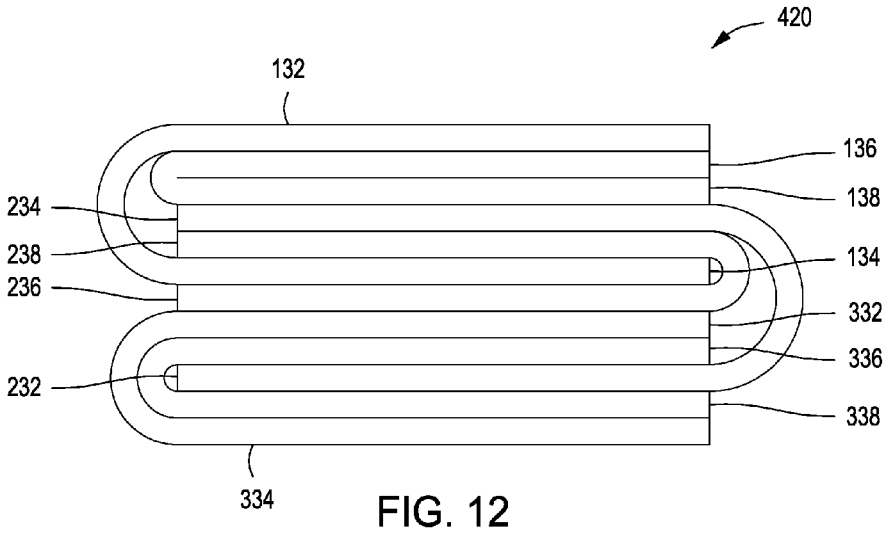
FIG. 12 shows an end view of the stack that is perpendicular to the view shown in FIG. 11, according to one or more embodiments described.

FIG. 11 shows a cross-sectional view of the second stack 420, and FIG. 12 shows an end view of the second stack 420 that is perpendicular to the view shown in FIG. 11, according to one or more embodiments. The second stack 420 can be assembled as follows: (1) the first smaller panel 132 of the first paper product 100, (2) the first larger panel 136 of the first paper product 100, (3) the second larger panel 138 of the first paper product 100, (4) the second smaller panel 234 of the second paper product 200, (5) the second larger panel 238 of the second paper product 200, (6) the second smaller panel 134 of the first paper product 100, (7) the first larger panel 236 of the second paper product 200, (8) the first smaller panel 332 of the third paper product 300, (9) the first larger panel 336 of the third paper product 300, (10) the first smaller panel 232 of the second paper product 200, (11) the second larger panel 338 of the third paper product 300, and (12) the second smaller panel 334 of the third paper product 300.

Figure 13:
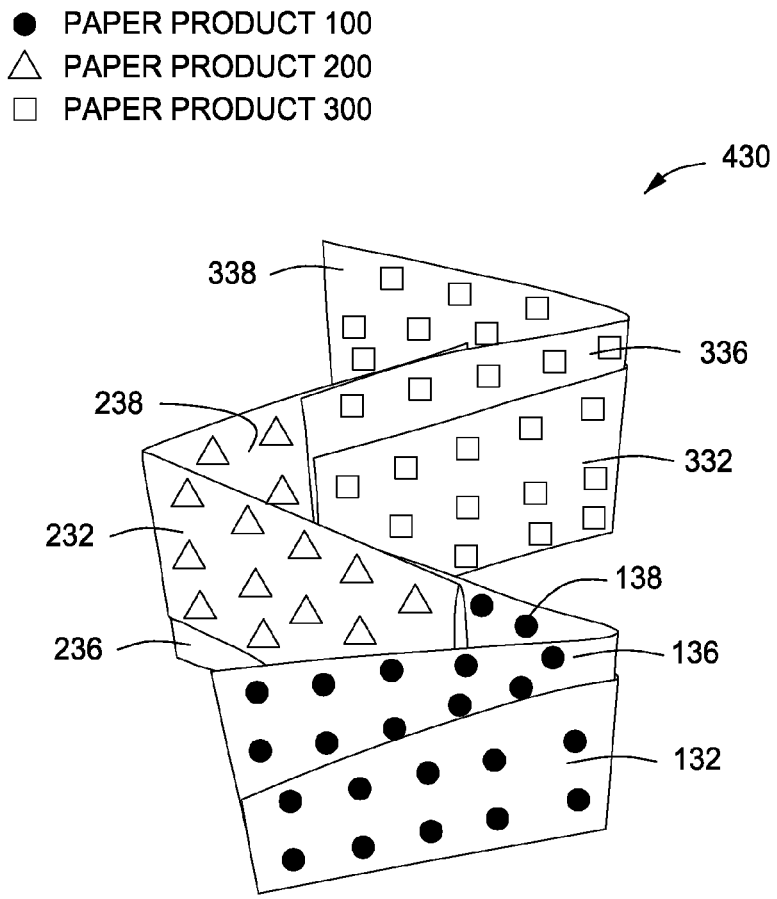
FIG. 13 shows a perspective view of another stack of a plurality of paper products after being assembled to form a third stack, according to one or more embodiments described.

FIG. 13 shows a perspective view of the paper products 100, 200, 300 after being assembled to form a third illustrative stack 430, according to one or more embodiments. In contrast to the first and second stacks 410, 420 above, the offset section 126 (see FIG. 4) of the second paper product 200 can be opposed to the offset sections 126 of the first and third paper products 100, 300. To form the third stack 430, any portion of the panels 232, 234, 236, 238 of the second paper product 200 can then be inserted at least partially between any two of the panels 132, 134, 136, 138 of the first paper product 100. Likewise, any portion of the panels 332, 334, 336, 338 of the third paper product 300 can be inserted at least partially between any two of the panels 232, 234, 236, 238 of the second paper product 200, and so on.

Figure 14:
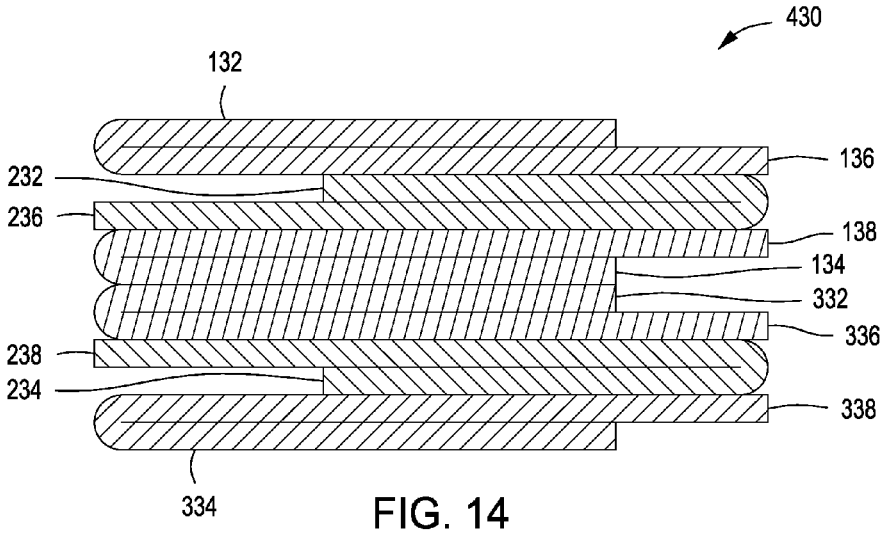
FIG. 14 shows a cross-sectional view of the stack shown in FIG. 13, according to one or more embodiments described.
Figure 15:
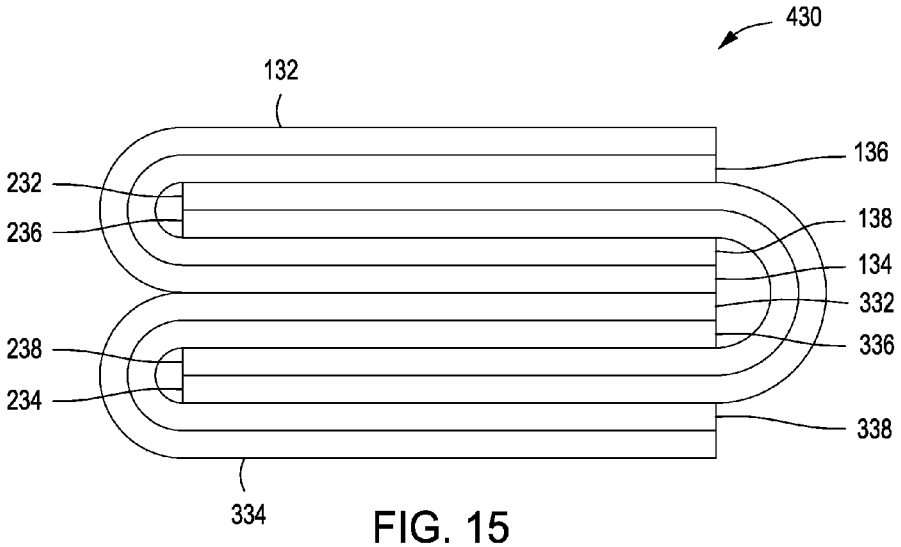
FIG. 15 shows an end view of the stack that is perpendicular to the view shown in FIG. 14, according to one or more embodiments described.

FIG. 14 shows a cross-sectional view of the third stack 430, and FIG. 15 shows an end view of the assembled stack 430 that is perpendicular to the view shown in FIG. 14, according to one or more embodiments. The third stack 430 can be assembled as follows: (1) the first smaller panel 132 of the first paper product 100, (2) the first larger panel 136 of the first paper product 100, (3) the first smaller panel 232 of the second paper product 200, (4) the first larger panel 236 of the second paper product 200, (5) the second larger panel 138 of the first paper product 100, (6) the second smaller panel 134 of the first paper product 100, (7) the first smaller panel 332 of the third paper product 300, (8) the first larger panel 336 of the third paper product 300, (9) the second larger panel 238 of the second paper product 200, (10), the second smaller panel 234 of the second paper product 200, (11) the second larger panel 338 of the third paper product 300, and (12) the second smaller panel 334 of the third paper product 300.

Figure 16:
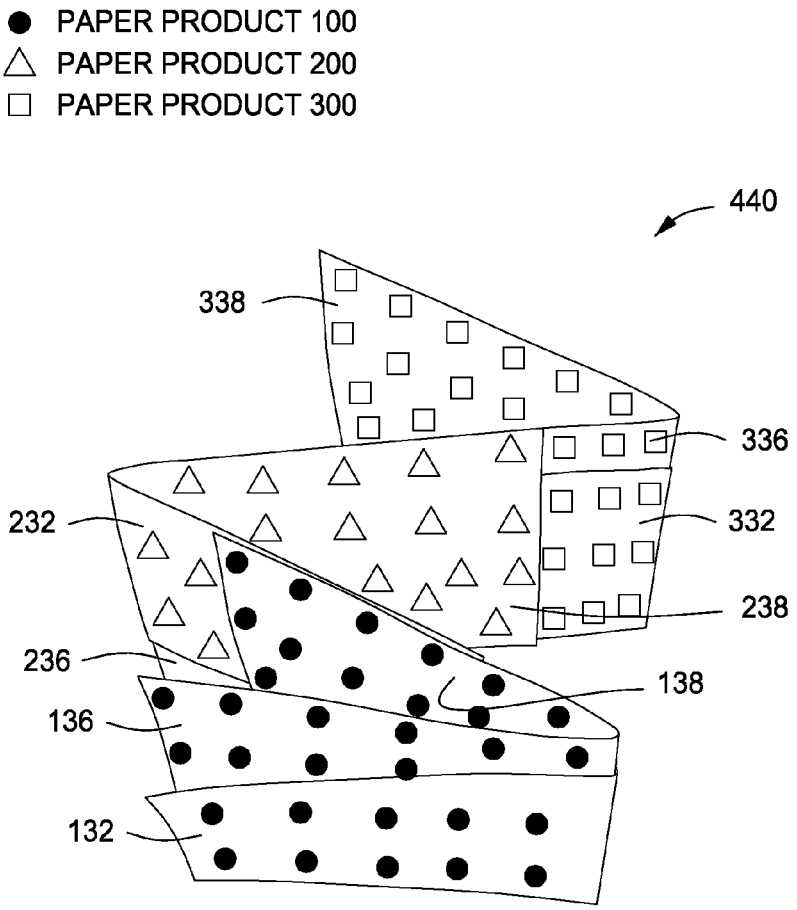
FIG. 16 shows a perspective view of yet another stack of a plurality of paper products after being assembled to form a fourth stack, according to one or more embodiments described.

FIG. 16 shows a perspective view of the paper products after being assembled to form a fourth illustrative stack 440, according to one or more embodiments. Similar to the third stack 430 above, the offset section 126 (see FIG. 4) of the second paper product 200 can be opposed to the offset sections 126 of the first and third paper products 100, 300. To form the fourth stack 440, any portion of the panels 232, 234, 236, 238 of the second paper product 200 can be inserted at least partially between any two of the panels 132, 134, 136, 138 of the first paper product 100. Likewise, any portion of the panels 332, 334, 336, 338 of the third paper product 300 can be inserted at least partially between any two of the panels 232, 234, 236, 238 of the second paper product 200, and so on.

Figure 17:
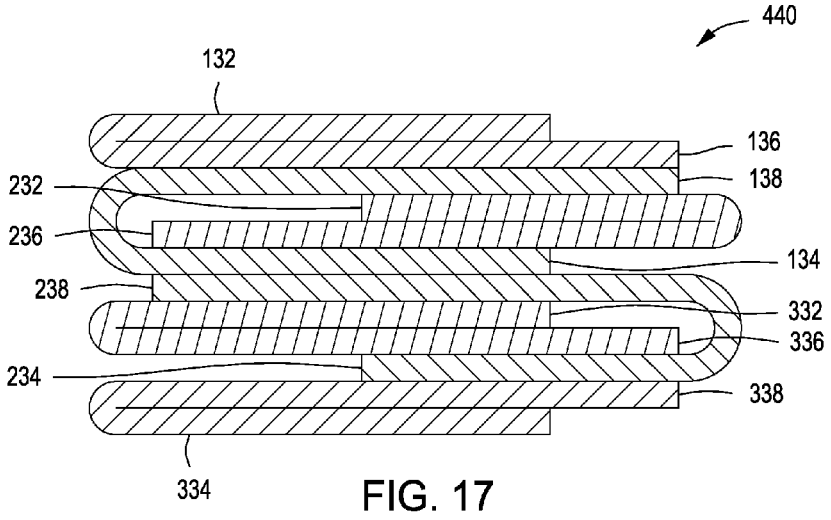
FIG. 17 shows a cross-sectional view of the stack shown in FIG. 16, according to one or more embodiments described.
Figure 18:
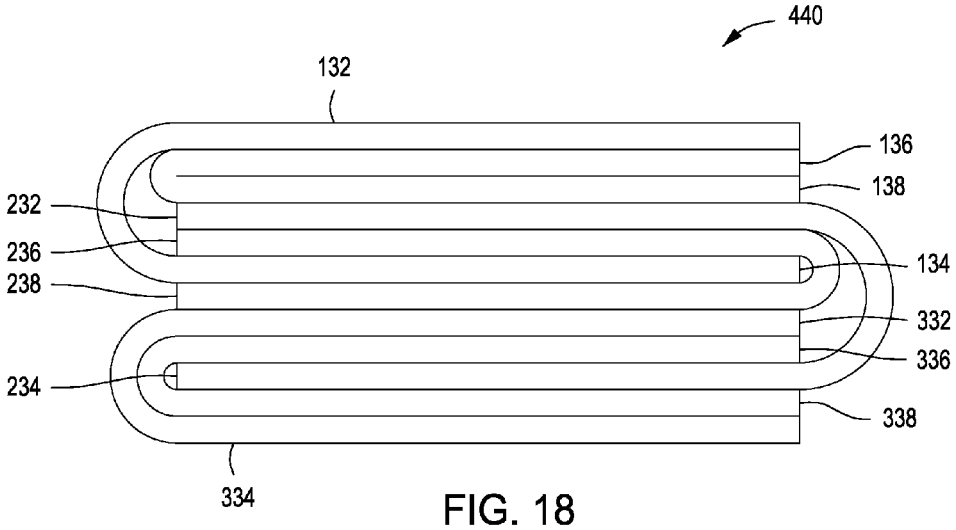
FIG. 18 shows an end view of the stack that is perpendicular to the view shown in FIG. 17, according to one or more embodiments described.

FIG. 17 shows a cross-sectional view of the fourth stack 440, and FIG. 18 shows an end view of the fourth stack 440 that is perpendicular to the view shown in FIG. 17, according to one or more embodiments. The fourth stack 440 can be assembled as follows: (1) the first smaller panel 132 of the first paper product 100, (2) the first larger panel 136 of the first paper product 100, (3) the second larger panel 138 of the first paper product 200, (4) the first smaller panel 232 of the second paper product 200, (5) the first larger panel 236 of the second paper product 200, (6) the second smaller panel 134 of the first paper product 100, (7) the second larger panel 238 of the second paper product 200, (8) the first smaller panel 332 of the third paper product 300, (9) the first larger panel 336 of the third paper product 300, (10) the second smaller panel 234 of the second paper product 200, (11) the second larger panel 338 of the third paper product 300, and (12) the second smaller panel 334 of the third paper product 300.

Although not shown, the paper products 100, 200, 300 can be assembled into a fifth stack. Similar to the first and second stacks 410, 420, the offset sections 126 of the paper products 100, 200, 300 in the fifth stack can be aligned. After the paper products 100, 200, 300 are assembled to form the fifth stack, the order from top to bottom can be as follows: (1) the first smaller panel 132 of the first paper product 100, (2) the first larger panel 136 of the first paper product 100, (3) the second smaller panel 234 of the second paper product 200, (4) the second larger panel 138 of the first paper product 100, (5) the second smaller panel 134 of the first paper product 100, (6) the second larger panel 238 of the second paper product 200, (7) the first smaller panel 332 of the third paper product 300, (8) the first larger panel 236 of the second paper product 200, (9) the first smaller panel 232 of the second paper product 200, (10), the first larger panel 336 of the third paper product 300, (11) the second larger panel 338 of the third paper product 300, and (12) the second smaller panel 334 of the third paper product 300.

Although not shown, the paper products 100, 200, 300 can be assembled into a sixth stack. Similar to the third and fourth stacks 430, 440, the offset section 126 of the second paper product 200 can be opposed to the offset sections 126 of the paper products 100, 300 above and below it. As used herein, the terms "above" and "below" and other like terms as used herein refer to relative positions to one another and are not intended to denote a particular direction or spatial orientation. After the paper products 100, 200, 300 are assembled to form the sixth stack, the order from top to bottom is as follows: (1) the first smaller panel 132 of the first paper product 100, (2) the first larger panel 136 of the first paper product 100, (3) the first smaller panel 232 of the second paper product 200, (4) the second larger panel 138 of the first paper product 100, (5) the second smaller panel 134 of the first paper product 100, (6) the first larger panel 236 of the second paper product 200, (7) the first smaller panel 332 of the third paper product 300, (8) the second larger panel 238 of the second paper product 200, (9) the second smaller panel 234 of the second paper product 200, (10) the first larger panel 336 of the third paper product 300, (11) the second larger panel 338 of the third paper product 300, and (12) the second smaller panel 334 of the third paper product 300.

Although not shown, the paper products 100, 200, 300 can be assembled into a seventh stack. Similar to the third, fourth, and sixth stacks, the offset section 126 of the second paper product 200 can be opposed to the offset sections 126 of the paper products 100, 300 above and below it. After the paper products 100, 200, 300 are assembled to form the seventh stack, the order from top to bottom is as follows: (1) the first smaller panel 132 of the first paper product 100, (2) the first larger panel 136 of the first paper product 100, (3) the first smaller panel 232 of the second paper product 200, (4) the second larger panel 138 of the first paper product 100, (5) the first larger panel 236 of the second paper product 200, (6) the second smaller panel 134 of the first paper product 100, (7) the first smaller panel 332 of the third paper product 300, (8) the second larger panel 238 of the second paper product 200, (9) the first larger panel 336 of the third paper product 300, (10) the second smaller panel 234 of the second paper product 200, (11) the second larger panel 338 of the third paper product 300, and (12) the second smaller panel 334 of the third paper product 300.

Although not shown, the paper products 100, 200, 300 can be assembled into an eighth stack. Similar to the third, fourth, sixth, and seventh stacks, the offset section 126 of the second paper product 200 can be opposed to the offset sections 126 of the paper products 100, 300 above and below it. After the paper products 100, 200, 300 form the eighth stack, the order from top to bottom is as follows: (1) the first smaller panel 132 of the first paper product 100, (2) the first larger panel 136 of the first paper product 100, (3) the second larger panel 138 of the first paper product 100, (4) the first smaller panel 232 of the second paper product 200, (5) the second smaller panel 134 of the first paper product 100, (6) the first larger panel 236 of the second paper product 200, (7) the second larger panel 238 of the second paper product 200, (8) the first smaller panel 332 of the third paper product 300, (9) the second smaller panel 234 of the second paper product 200, (10) the first larger panel 336 of the third paper product 300, (11) the second larger panel 338 of the third paper product 300, and (12) the second smaller panel 334 of the third paper product 300.

Figure 19:
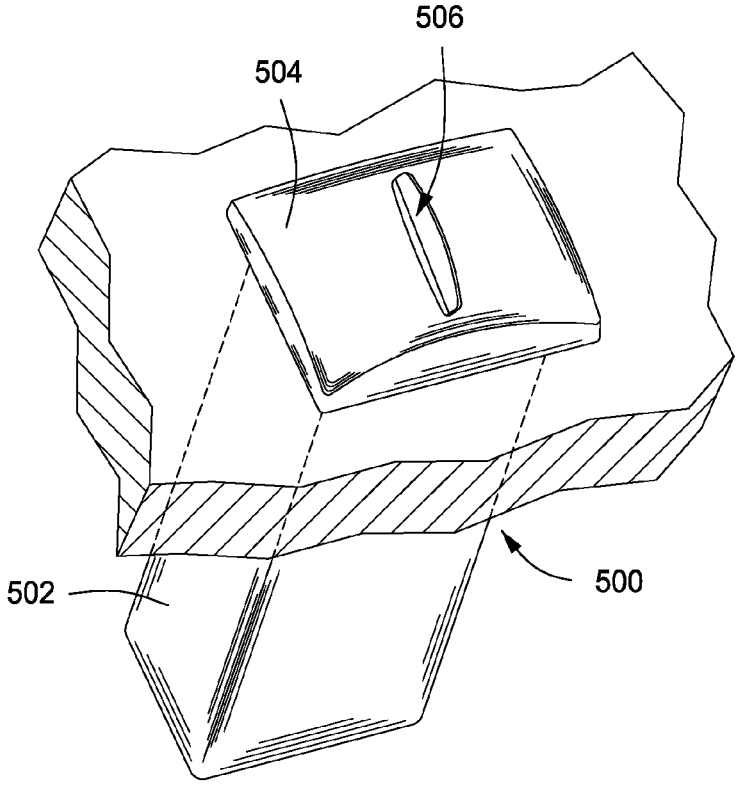
FIG. 19 shows a perspective view of an illustrative paper product dispenser, according to one or more embodiments described.

FIG. 19 shows a perspective view of an illustrative paper product dispenser 500, according to one or more embodiments. The dispenser 500 can include a housing 502, a face plate 504, a movable support plate (not shown), and a biasing spring (not shown). The housing 502 and the face plate 504 can define a storage chamber that is adapted to receive a stack of paper products (e.g., stacks 410, 420, 430, and/or 440). The face plate 504 can include an opening 506 formed therethrough, and one or more paper products (e.g., paper products 100, 200, 300) can be removed one at a time from the chamber through the opening 506. The biasing spring can move the support plate within the chamber to bias the stack 410, 420, 430, and/or 440 toward the face plate 504 and the opening 506. Other illustrative dispensers 400 can include those discussed and described in U.S. Pat. Nos. 7,938,294; 7,568,593; 7,546,934; 7,341,166; 6,892,898; 6,874,653; 6,622,888; 6,585,129; and 4,679,703.

Each of the eight stacks described above can be repeating for the desired number of paper products 100, 200, 300 in the paper product dispenser 500. In another embodiment, two or more stacks can be used in the paper product dispenser 500. Placing the paper products 100, 200, 300 in one of the eight stacks described above can reduce the space taken up by the stack when the stack is loaded into the chamber of the dispenser 500, thereby increasing the number of paper products 100, 200, 300 that can be loaded into the chamber. In addition, placing the paper products 100, 200, 300 in one of the eight stacks described above can allow a user to withdraw one paper product 100, 200, 300 at a time, and prevent the user from inadvertently withdrawing multiple paper products 100, 200, 300 with a single pull when multiple paper products 100, 200, 300 are not desired.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present disclosure, other and further embodiments of the disclosure may be devised without departing from the basic scope thereof, and the scope thereof is determined by the claims that follow.

What is claimed is:

1. A stack of folded paper products, comprising:
first and second paper products each having:
a first centerline extending therethrough;
a first fold line extending therethrough that is substantially parallel to, and offset from, the first centerline;
a second centerline extending therethrough that is substantially perpendicular to the first centerline; and
a second fold line extending therethrough that is substantially parallel to the second centerline; wherein:
the first and second paper products are each folded about the first fold line prior to being folded about the second fold line, thereby forming first and second larger panels and first and second smaller panels,
the first and second larger panels each include an offset section that extends a distance beyond the first and second smaller panels,
the first centerline is positioned substantially halfway along a width of the first and second paper products,
a ratio of the distance to the width is 1:4 to about 1:40, and
at least one of the panels of the second paper product is at least partially disposed between at least two of the panels of the first paper product to provide the stack.

2. The stack of claim 1, wherein the offset sections of the first paper product are aligned with the offset sections of the second paper product, and wherein the second larger panel and the second smaller panel of the second paper product are each at least partially disposed between the second larger panel and the second smaller panel of the first paper product.

3. The stack of claim 1, wherein the distance is from about 0.5 cm to about 10 cm.

4. The stack of claim 1, wherein the ratio of the distance to the width is about 1:6 to about 1:30.

5. The stack of claim 1, wherein the offset sections of the first paper product are aligned with the offset sections of the second paper product.

6. The stack of claim 1, wherein the offset sections of the first paper product are located on opposing sides of the stack with respect to the offset sections of the second paper product.

7. The stack of claim 1, wherein the first and second larger panels are disposed at least partially between the first and second smaller panels.

8. The stack of claim 1, wherein the first larger panel and the first smaller panel of the second paper product are each at least partially disposed between the first and second larger panels of the first paper product.

9. The stack of claim 1, wherein the first larger panel and the first smaller panel of the second paper product are each at least partially disposed between the second larger panel and the second smaller panel of the first paper product.

10. The stack of claim 1, wherein the first and second smaller panels of the first paper product in the stack are substantially aligned with the first and second smaller panels of the second paper product in the stack.

11. A stack of folded paper products, comprising:
first and second paper products each having:
a first centerline extending therethrough;
a first fold line extending therethrough that is substantially parallel to, and offset from, the first centerline, wherein the first fold line is parallel with a longer side of the first and second paper products;
a second centerline extending therethrough that is substantially perpendicular to the first centerline; and
a second fold line extending therethrough that is substantially parallel to and substantially aligned with the second centerline, wherein:
the first and second paper products are each folded about the first fold line prior to being folded about the second fold line, thereby forming first and second larger panels and first and second smaller panels,
at least one of the panels of the second paper product is at least partially disposed between at least two of the panels of the first paper product to provide the stack.

12. A stack of folded paper napkins, comprising:
first and second paper napkins each having:
a first centerline extending therethrough;
a first fold line extending therethrough that is substantially parallel to, and offset from, the first centerline;
a second centerline extending therethrough that is substantially perpendicular to the first centerline; and
a second fold line extending therethrough that is substantially parallel to, and substantially aligned with, the second centerline; wherein:

the first and second paper napkins are each folded about the first fold line prior to being folded about their respective second fold lines, thereby forming first and second larger panels that are each at least partially disposed between first and second smaller panels, the first and second larger panels of the first and second paper napkins each include an offset section that extends a distance beyond the first and second smaller panels, the first centerline is positioned substantially halfway along a width of the first and second paper napkins, a ratio of the distance to the width is 1:4 to about 1:40, and at least one of the panels of the second paper napkin is at least partially disposed between at least two of the panels of the first paper napkin to provide the stack.

13. The stack of claim 12, wherein the offset sections of the first paper napkin are aligned with the offset sections of the second paper napkin, and wherein the second larger panel and the second smaller panel of the second paper napkin are each at least partially disposed between the first and second larger panels of the first paper napkin.

14. The stack of claim 12, wherein the offset sections of the first paper napkin are aligned with the offset sections of the second paper napkin, and wherein the second larger panel and the second smaller panel of the second paper napkin are each at least partially disposed between the second larger panel and the second smaller panel of the first paper napkin.

15. The stack of claim 12, wherein the offset sections of the first paper napkin are opposed to the offset sections of the second paper napkin, and wherein the first larger panel and the first smaller panel of the second paper napkin are each at least partially disposed between the first and second larger panels of the first paper napkin.

16. The stack of claim 12, wherein the offset sections of the first paper napkin are opposed to the offset sections of the second paper napkin, and wherein the first larger panel and the first smaller panel of the second paper napkin are each at least partially disposed between the second larger panel and the second smaller panel of the first paper napkin.

17. A method for forming a stack of folded paper products, comprising:

folding a first paper product about a first fold line that is substantially parallel to, and offset from, a first centerline extending therethrough, wherein the first centerline extending through the first paper product is substantially halfway along a width of the first paper product;

folding the first paper product about a second fold line that is substantially perpendicular to the first fold line after the first paper product is folded about the first fold line, thereby forming first and second larger panels and first and second smaller panels, wherein each of the first and second larger panels formed by folding the first paper product about the second fold line include an offset section that extends a first distance beyond the first and second smaller panels formed by folding the first paper product about the second fold line, and wherein a ratio of the first distance to the width of the first paper product is 1:4 to about 1:40;

folding a second paper product about a first fold line that is substantially parallel to, and offset from, a first centerline extending therethrough, wherein the first centerline extending through the second paper product is substantially halfway along a width of the second paper product;

folding the second paper product about a second fold line that is substantially perpendicular to the first fold line after the second paper product is folded about the first fold line of the second paper product, thereby forming first and second larger panels and first and second smaller panels, wherein each of the first and second larger panels formed by folding the second paper product about the second fold line include an offset section that extends a second distance beyond the first and second smaller panels formed by folding the second paper product about the second fold line, and wherein a ratio of the second distance to the width of the second paper product is 1:4 to about 1:40; and inserting at least one of the panels of the second paper product at least partially between at least two of the panels of the first paper product to provide the stack.

18. The method of claim 17, wherein inserting at least one of the panels of the second paper product at least partially between at least two of the panels of the first paper product comprises inserting the first larger panel and the first smaller panel of the second paper product at least partially between the first and second larger panels of the first paper product.

19. The method of claim 18, further comprising:

folding a third paper product about a first fold line that is substantially parallel to, and offset from, a first centerline extending therethrough;

folding the third paper product about a second fold line that is substantially perpendicular to the first fold line after the third paper product is folded about the first fold line, thereby forming first and second larger panels and first and second smaller panels; and inserting the first larger panel and the first smaller panel of the third paper product at least between the first and second larger panels of the second paper product.

20. The method of claim 17, wherein inserting at least one of the panels of the second paper product at least partially between at least two of the panels of the first paper product comprises inserting the first larger panel and the first smaller panel of the second paper product at least partially between the second larger panel and the second smaller panel of the first paper product.

21. The method of claim 20, further comprising:

folding a third paper product about a first fold line that is substantially parallel to, and offset from, a first centerline extending therethrough;

folding the third paper product about a second fold line that is substantially perpendicular to the first fold line after the third paper product is folded about the first fold line, thereby forming first and second larger panels and first and second smaller panels; and inserting the first larger panel and the first smaller panel of the third paper product at least between the first and second larger panels of the second paper product.

* * * * *